United States Patent [19]

Bunnell et al.

[11] 3,960,430

[45] June 1, 1976

[54] FLAT WIRING SYSTEM AND CRIMPED CONNECTION

[75] Inventors: Edward Dennman Bunnell, Palm Harbor; James Earl Fleischhacker, Clearwater; Robert John Tennant, Seminole, all of Fla.

[73] Assignee: AMP Incorporated, Harrisburg, Pa.

[22] Filed: Oct. 29, 1974

[21] Appl. No.: 518,422

[52] U.S. Cl. ..... 339/97 C; 174/48; 174/84 C; 174/88 R

[51] Int. Cl.[2] ..... H01R 11/20

[58] Field of Search ..... 339/95 R, 97 R, 97 C, 339/98, 99 R, 258 S; 174/48, 84 C, 88 P

[56] References Cited

UNITED STATES PATENTS

| | | | |
|---|---|---|---|
| 3,395,381 | 7/1968 | Huffnagle | 339/97 C |
| 3,533,048 | 10/1970 | Teagno et al. | 339/95 R |
| 3,703,604 | 11/1972 | Henchen et al. | 339/97 C X |
| 3,715,457 | 2/1973 | Teagno et al. | 174/88 R |
| 3,814,836 | 6/1974 | Neale, Sr. | 339/97 C X |
| 3,857,995 | 12/1974 | Wyrick | 339/97 C X |

*Primary Examiner*—Joseph H. McGlynn
*Assistant Examiner*—Howard N. Goldberg
*Attorney, Agent, or Firm*—Frederick W. Raring; Robert W. Pitts; Jay L. Seitchik

[57] ABSTRACT

Power distribution system for building wiring comprises a flat three conductor cable which is mounted on a surface, such as a floor, and tap cables extending laterally to outlets, loads, and controls. The tap connections of the branch or tap cables are made with electrical connectors crimped onto conductors in the distribution cable and the brand cable. An improved crimp is disclosed for making these connections.

17 Claims, 16 Drawing Figures

FLAT WIRING SYSTEM AND CRIMPED CONNECTION

BACKGROUND OF THE INVENTION

This invention relates to improved crimped connections for ribbon-like conductors in a flat conductor cable and to wiring systems which are installed using flat cable.

Flat conductor cable comprises ribbon-like conductors contained in a thin sheet or film of insulating material. Flat cables of this type are being widely used for interconnections involving electronic instruments, printed circuit boards, and other circumstances where the voltage and power requirements are relatively low and the conductors are correspondingly small. Flat cables are not, however, being used for building wiring although such cables were first proposed for this use in the 1880's. It is probable that insulation and electrical connection problems as well as the cost of the cables prevented the adoption of flat conductor building wiring systems during those early years.

Not withstanding the renewed interest in flat conductor cables during recent years, such cables are not being used for building wiring applications because of the difficulty of making electrical connections to the conductors in the cable. Soldered connections are impractical and while there are available good crimped connections for flat conductors (see to Huffnagle U.S. Pat. No. 3,395,381) most of these crimped connections are comparatively bulky and there use in building wiring systems would be impractical in that they would cancel out the advantages of using flat conductor cable.

In accordance with one aspect of the instant invention, an improved crimped connection is provided for flat conductors in a flat cable which can be made with relatively simple tools at a work site such as by an electrician installing the wiring in a building under construction. The crimped connection has an extremely low profile so that the crimped connecting device does not project significantly beyond the surfaces of the flat cable. The invention is further directed to the achievement of a flat cable power distribution system in a building which may be provided on a wall or floor surface and in accordance with which electrical outlets, supply cables, and switches can be conveniently provided at any desired location.

It is accordingly an object of the invention to provide an improved crimped connection for flat conductors in a flat conductor cable. A further object is to provide a low profile and compact crimped connection. A further object is to provide a crimped connection for flat conductors which can be made with relatively simple tools and which will be effective to serve as a low resistance, long lived connection in the system in which it is installed. A still further object is to provide a building power distribution system employing flat conductor cables which can be quickly and efficiently installed, which occupies a minimum amount of space, and which can be modified to provide additional electrical outlets or for other purposes with a minimum amount of time and inconvenience.

These and other objects of the invention are achieved in preferred embodiments thereof which are briefly described in the foregoing abstract, which are described in detail below, and which are shown in the accompanying drawing in which.

Figure 10:
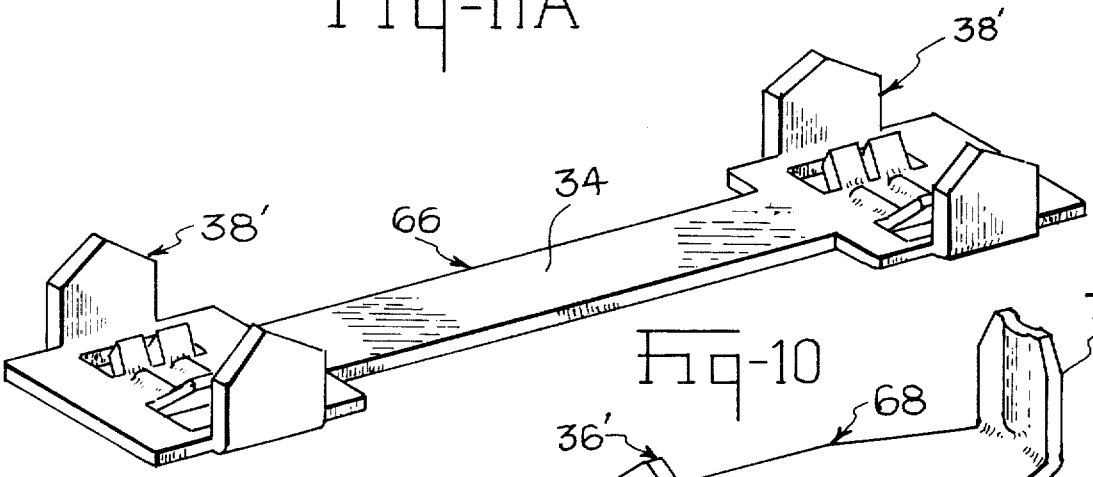
Figure 8:
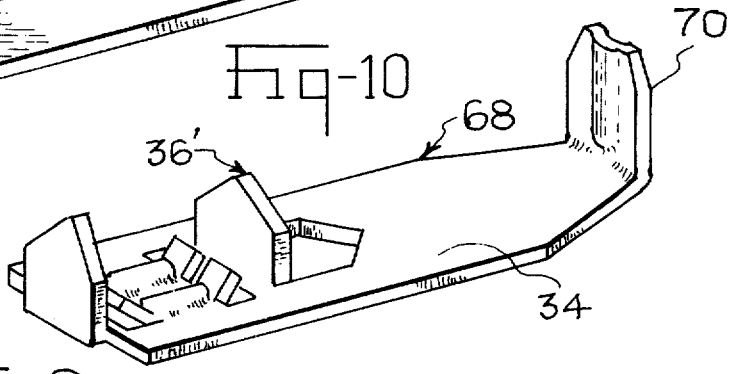
Figure 9:
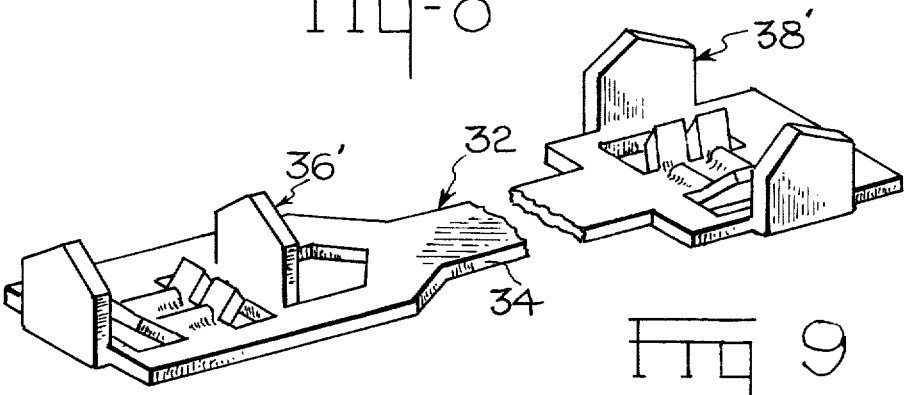

FIGS. 8, 9, and 10 show different forms of connecting devices employed in the practice of the invention.

Figure 11A:
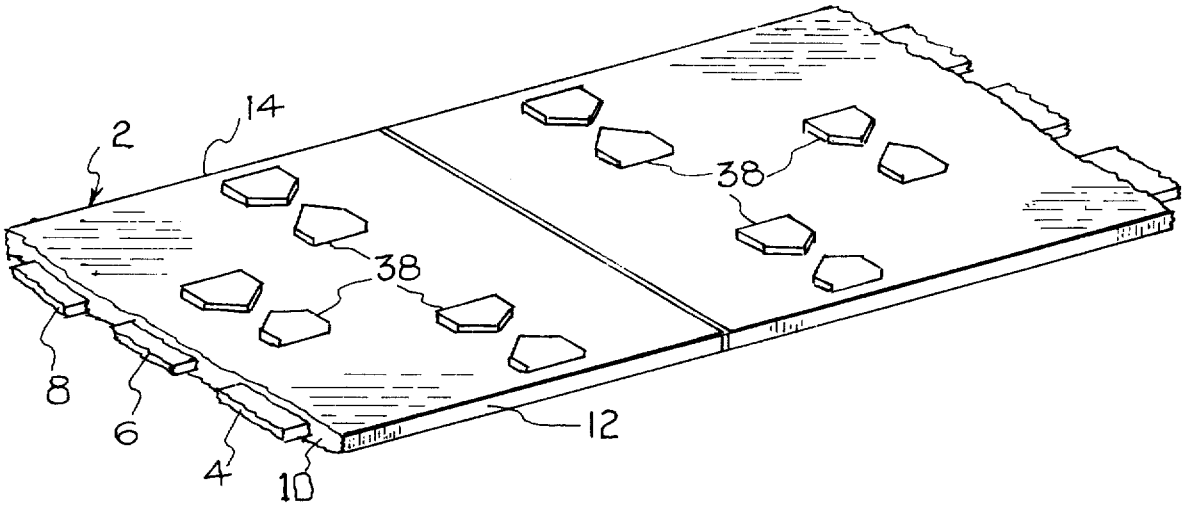
Figure 11:
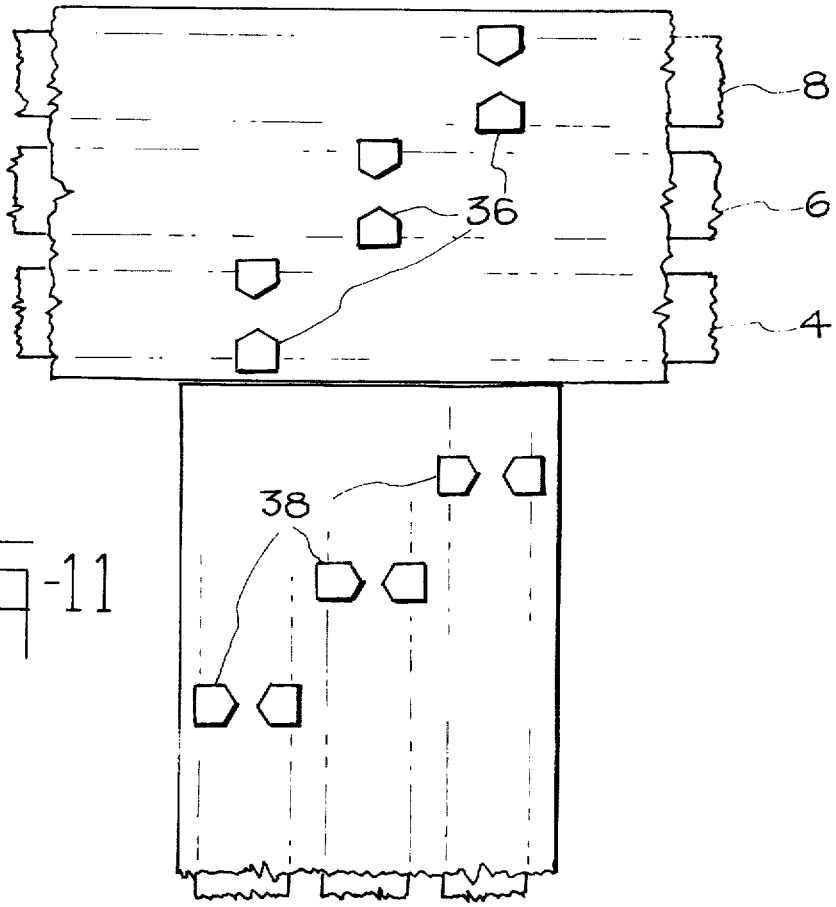

FIG. 11 is a plan view of a tap splice between a distribution cable and a branch cable.

FIG. 11A is a perspective view of a butt splice.

Figure 12:
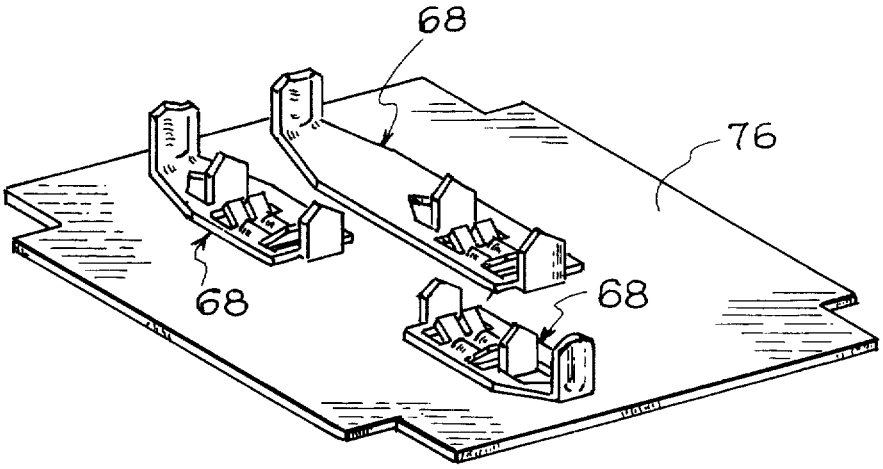
Figure 14:
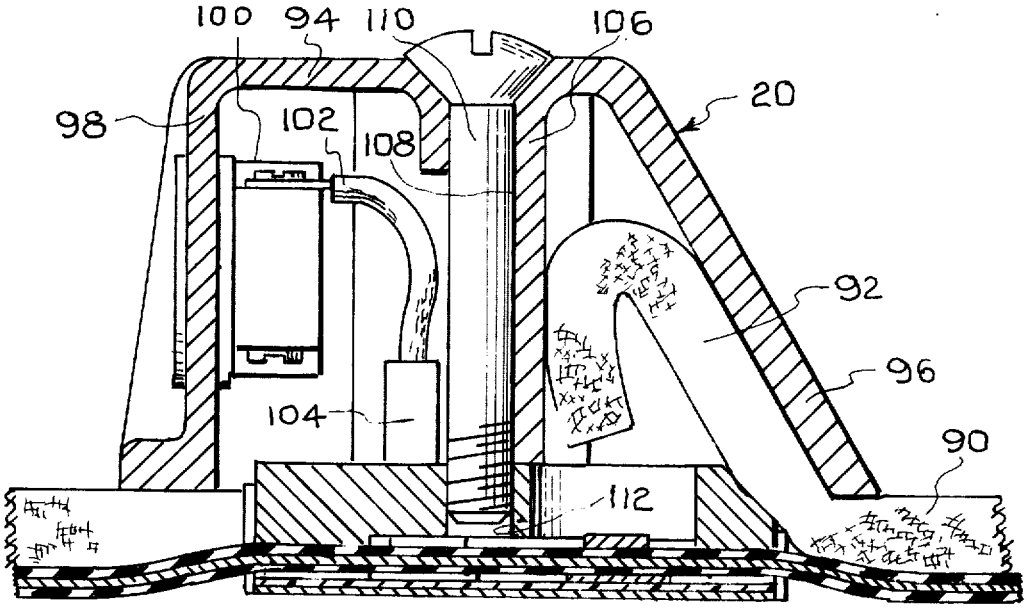

FIG. 12 is a perspective view of three connecting devices of the type shown in FIG. 8 mounted on a sheet of insulating film, this unit being used to provide an outlet on the cable of the type shown in FIG. 14.

Figure 12A:
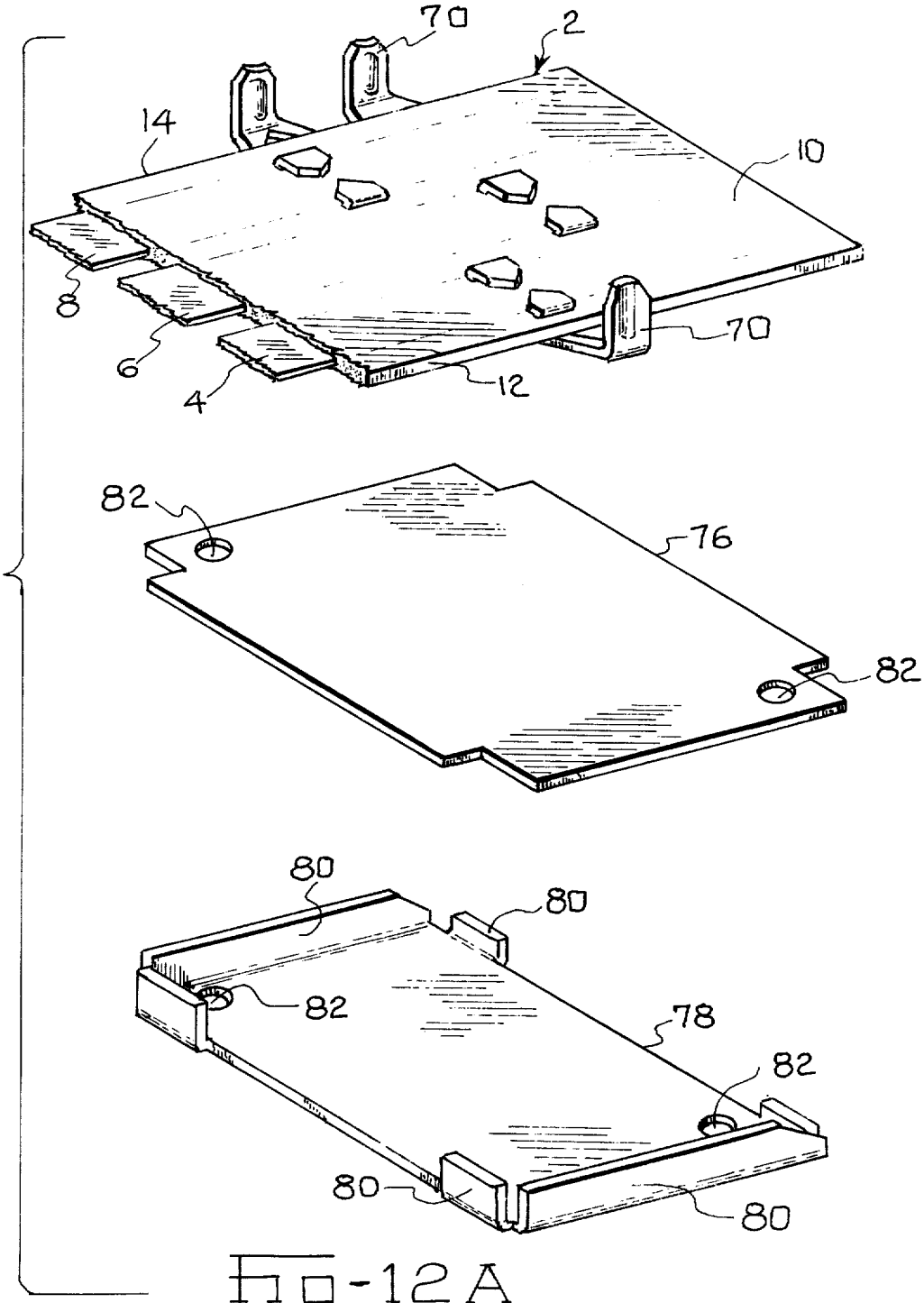

FIG. 12A is an exploded view of the cable, the crimped connecting devices, and an insulating film and floor plate used for an outlet as shown in FIG. 14.

Figure 13:
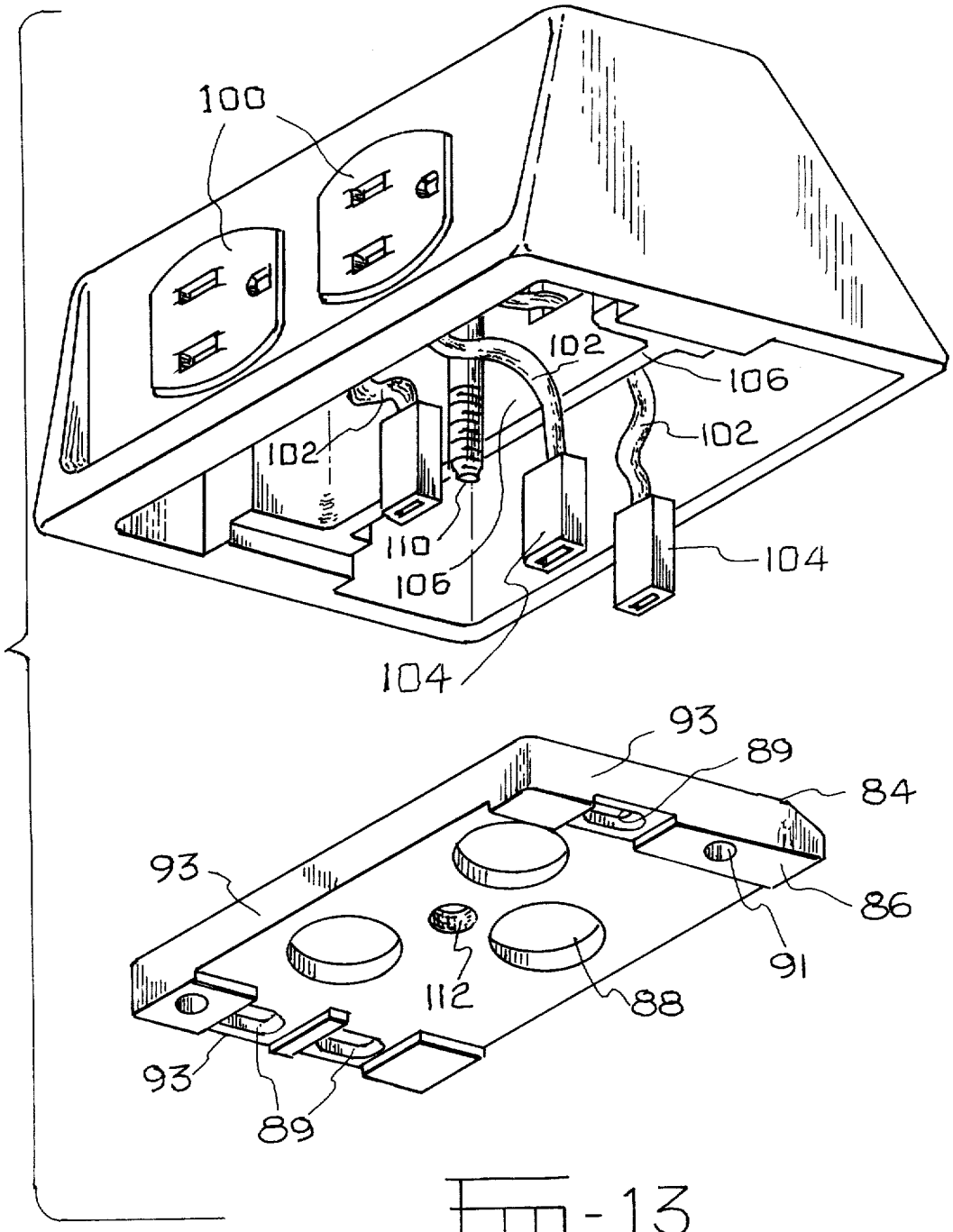

FIG. 13 is a perspective, exploded view of an electrical outlet and a base plate which is used with the outlet.

Figure 3:
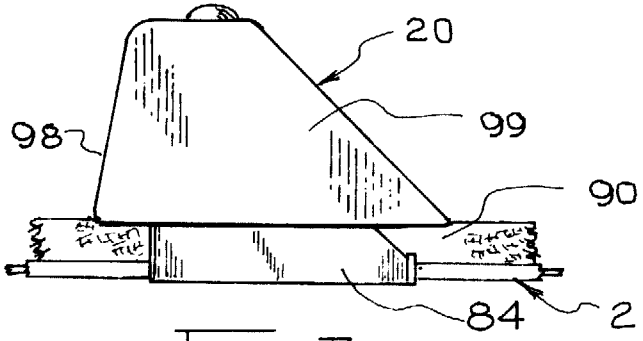
FIG. 2 and 3 are front and side views respectively of an electrical outlet which is part of the system of FIG. 1.
Figure 2:
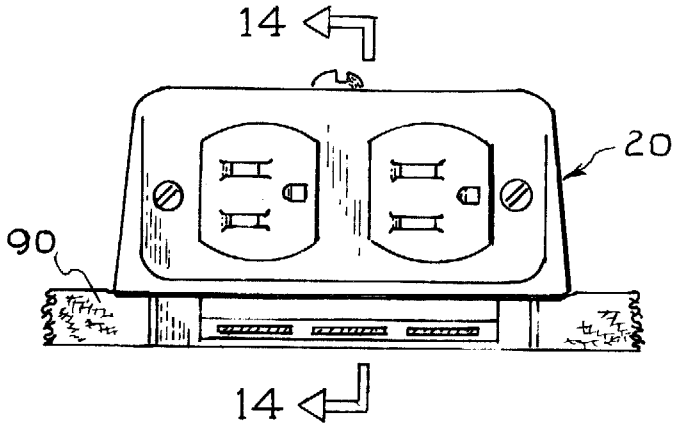

FIG. 14 is a sectional side view taken along the lines 14—14 of FIG. 2 of an electrical outlet on a cable in accordance with the invention.

Referring first to FIG. 11A, the flat conductor cable 2 used in the practice of the invention comprises spaced apart parellel ribbon-like conductors 4, 6, 8, which are contained in an insulating film 10 having parallel side edges 12, 14. The conductors are conventionally of rolled copper and the film is of a suitable, tough polymeric material such as Mylar (polyethyleneterephthlate). Commercially available cable of the type shown which is intended for ordinary building wiring has a width of about 6.3 cm. and the conductors are about 1.5 cm. wide. The cable 2 is relatively thin so that it can be placed on a wall or floor and readily covered with a carpet or a thin panel to provide unobtrusive and compact wiring in a building.

Figure 1:
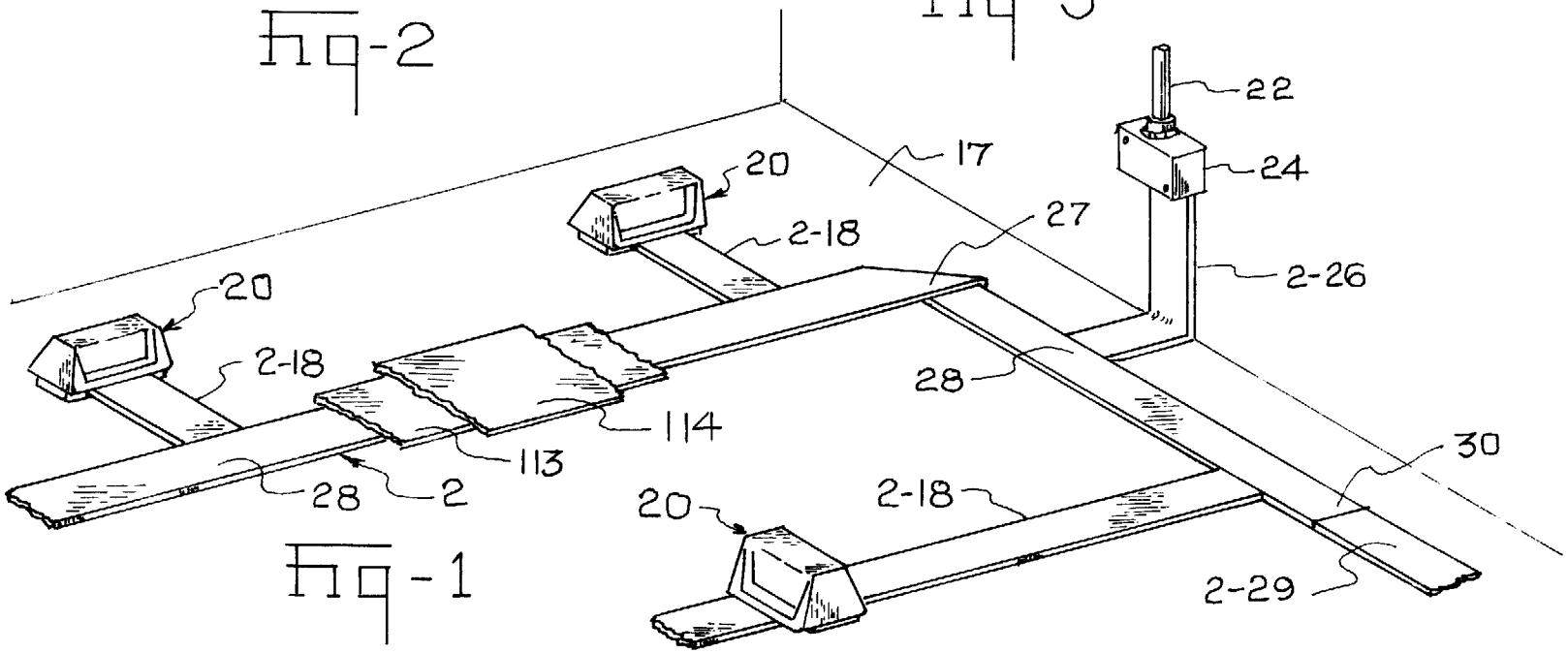
FIG. 1 is a fragmentary view of a portion of a distribution system in accordance with the invention, this view showing the electrical cables on the floor of a building during the final stages of construction.

As shown in FIG. 1, the wiring system for a room requiring outlets at many locations on the floor 17 thereof, may comprise a distribution cable 2–26 which extends around the floor and branch cables 2–18 which extend to receptacles generally indicated at 20. Power is supplied to the distribution cable 2–16 by a conventional three wire cable 22 which is connected in a junction box 24 to a feed-in cable 2–26. The branch cables 2–18 are connected to the distribution cable by tap connections generally indicated at 28 and described in detail below. If necessary, a section 2–29 may be added by a butt splice 30 to extend the distribution cable. The cable is laid flat against the floor and is folded as shown at 27 where its direction must be changed. It is desirable, under many circumstances, to provide a layer of foam material 113 over the cables 2 for protection against moisture and to lay cold rolled steel strip 114 over the branch and distribution cables to protect the conductors against penetration by foreign objects.

Tap connections as shown at 28 are made with tap connectors 32, FIG. 9, each of which comprises an elongated strip of conductive sheet metal 34 such as brass, having crimp portions 36', 38' at its ends. The crimp portion 38' is crimped onto a conductor in the branch cable which extends parallel to the length of the shank 34 while the crimp portion 36' is crimped onto a conductor which extends transversely of the connector as shown in FIG. 11. The crimped connections are substantially alike and accordingly, a crimped connection for a central conductor 6 in a distribution cable 2–26 will be described in detail.

Figure 4:
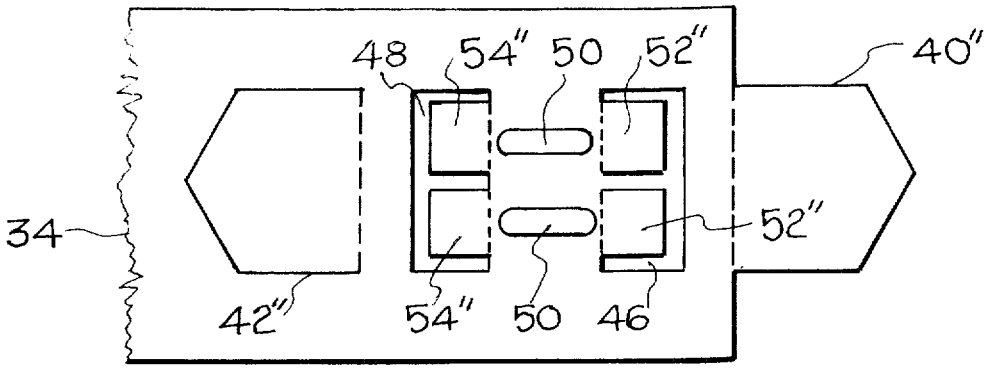
FIG. 4 is a plan view of a sheet metal blank from which a connecting device is formed which is used in the practice of the invention.
Figure 5:
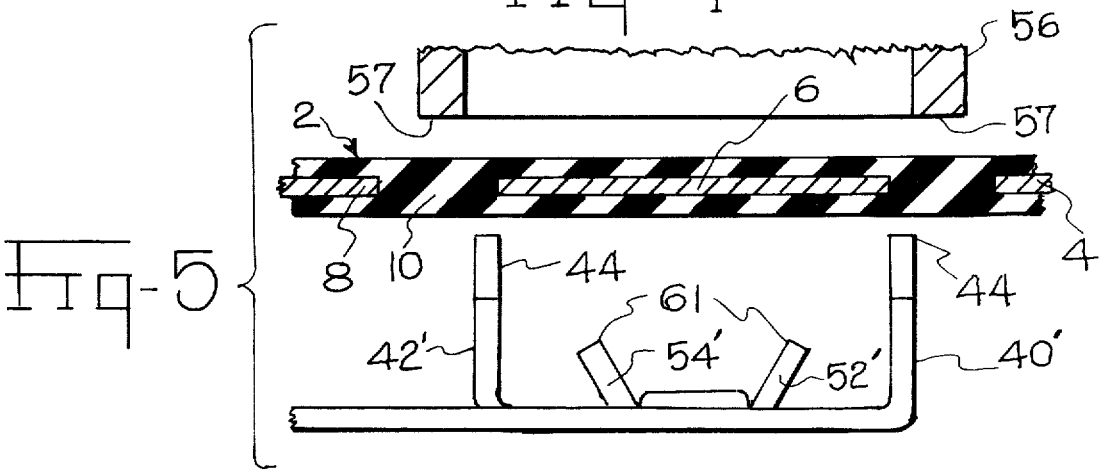
FIG. 5 is a fragmentary side view of a connecting device in accordance with the invention showing the crimp portion of the device with a cable and an installation tool in alignment therewith preparatory to making a crimped connection.

Referring now to FIGS. 4–7, the crimp portion 36' of the connecting device 34 is made by shearing at 42'', a flat metal blank and trimming the end of the blank at 40''. The sheared and trimmed sections are formed upwardly in the same direction to provide spaced apart holding or retaining lances 40', 42' which extend normally of the plane of the shank 34, these holding lances having pointed upper ends 44 to facilitate penetration of the insulation 10 of the cable. E-shaped openings 46, 48 are die cut in the blank between the sheared and trimmed portions 42'', 40'' and strengthening bosses 50 are formed between these openings as shown in FIG. 4 to stiffen the web portion of the finished crimped connection. As shown in FIG. 4, the slots which define the opposed E-shaped openings 46, 48 are of substantial width and they define spaced apart lances 52'' and 54'' which are formed upwardly so that they extend at an angle of about 60° with respect to the plane of the connector and towards the holding or retaining lances 40', 42'. These lances 52', 54' serve as electrical contact lances and it is desirable that their upper edges 61 be relatively sharp so that they will scrape or skive insulation 10 from the underside of the conductor 6 as described below.

In crimping the crimp portion 36' onto the conductor 6, the cable is first positioned above the connecting device with the conductor 6 extending between the lances 40', 42'. A first tool 56 is then moved downwardly against the cable to drive the lances 40', 42' relatively through the film until the cable is positioned against the contact lances 42', 54'. This first tool 56 may be in the form of a tube having an inside diameter which is slightly greater than the distance between the outwardly facing surfaces of the retaining lances 40', 42' so that when the tool is moved downwardly from the position of FIG. 5, the film will be impaled on the lances by the end surface 57 of the tool.

Figure 6:
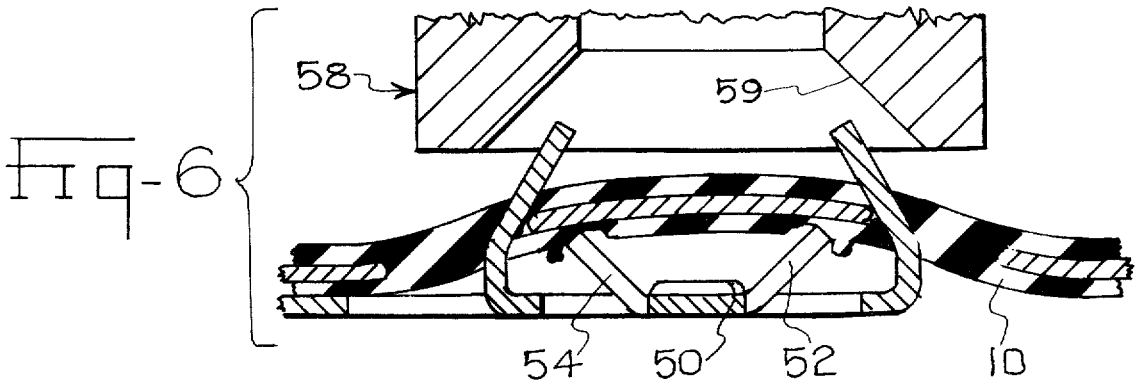
FIG. 6 is a view showing an intermediate stage in the making of the crimped connection.

A second tool 58 in the form of a tube having a conical end surface 59 is then positioned above the pointed upper ends 44 of the holding lances and moved downwardly until these lances are bent partially inwardly so that they extend towards each other over the upper surface of the cable. FIG. 6 shows the positions of lances 40', 42' after they have been partially bent by tool 58. During this step, the contact lances 42', 54' will be bent partially downwardly towards the plane of the shank portion 34 of the connector.

Figure 7:
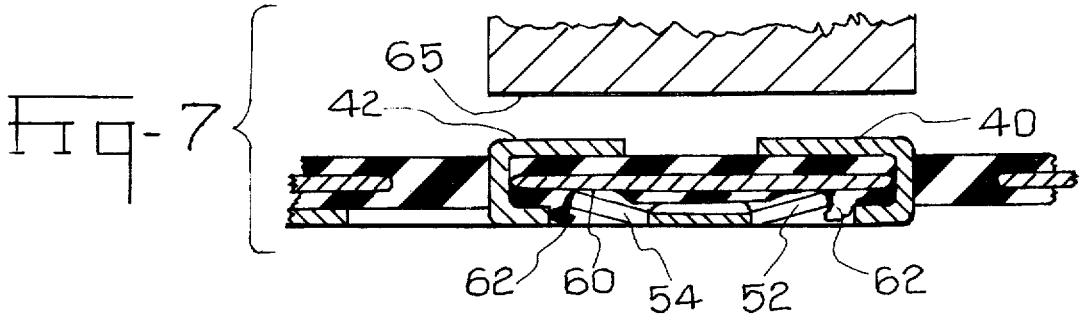
FIG. 7 is a sectional view of a crimped connection in accordance with the invention.

The retention lances 40, 42 are then bent downwardly until they extend horizontally as viewed in FIG. 7 towards each other and they are flat against the upper surface of the film. This final bending step is carried out by a third tool which has a flat forming surface 65 as shown in FIG. 7. During this final bending step, the contact lances 52, 54 are bent downwardly and the leading edges 61 of these lances are moved relatively over the undersurface of the conductor 6 and the insulating film. These edges scrape insulation from the underside of the cable and the scraped debris will be accumulated at the leading ends of the lances as shown at 62 in FIG. 7. The clearance provided by the die cut E-shaped openings 46, 48 provides space for the flow of this accumulated insulation as shown in FIG. 7 so that it does not interfere with the electrical characteristics of the crimp.

In the finished crimped connection then, the underside of the conductor 6 is partially exposed adjacent to the leading end of each lance as shown at 60 and the lances 52, 54, having been bent downwardly, have a tendency to spring back to their original positions and are thereby maintained against the surface 60 of the conductor. The tendency of the lances 52, 54 to spring upwardly from the position of FIG. 7 is counteracted by the bent-over holding or retaining lances 40, 42 thereby assuring continuing electrical contact between the conductor and the contact lances. The finished crimped connection thus has a flat web which is co-planar with the central portion 34 of the connector and the holding or retaining lances extend as sidewalls through the film 10 and then towards each other over the upper surface of the film with the free ends of the holding lances 40, 42 overlapping the free ends of the contact lances. The overall height of the crimped connection is not significantly greater than the thickness of the film as is apparent from FIG. 7 so that the crimped connection does not create an obvious bulge when the cable is later covered with carpeting or other covering. The ribs or bosses 50 stiffen the web portion and prevent relaxation of the contact lances.

The crimp portion 38' of the connecting device 32 is the same as the crimp portion 36' excepting that the holding and contact lances extend parallel to the length of the shank part in 34 of the connecting device so that the conductor will extend normally of a conductor in a crimped connection 36, see FIG. 11. A connecting device 66, FIG. 10, for making a butt splice (FIG. 11A) has two crimp portions 38', one at end end thereof, so that it will connect two conductors extending towards each other. FIG. 8 shows a tab connector having a shank portion with a crimp portion 36' at one end thereof and a tab 70 extending from its other end. This connecting device is used to connect the conductors extending from a receptacle to the conductors in a cable as will be described below.

Referring now to FIGS. 12 and 12A, the three tab connectors 68 which are required for an outlet 20 are preferably supplied to the user with their undersides bonded to a generally rectangular sheet 76 of insulating film. As shown in FIG. 12, two of the tab connectors are relatively short and are intended to be crimped onto the conductors 4, 8 and the other connecting device has a larger shank portion 34 so that it can be crimped onto the center conductor 6.

At the time of installation of the wiring in a building, connecting device assemblies of the general type shown in FIG. 12 are used to make the butt splices 30 and tap splices 28 where required. The assembly for a butt splice 30 has three connecting devices of the type shown at 66, FIG. 10, on the sheet of plastic film 76 while the assembly for a tap splice 28 has three connecting devices of the type shown at 32, FIG. 9. As shown in FIG. 11A, it may be advantageous to provide connecting devices 66 for butt splices in two different lengths so that the three crimped connections will not be aligned. In the case of a tap splice, FIG. 11, the crimped connections on the branch cable will not be in alignment if three identical connecting devices 32 are used.

When a receptacle outlet 20 is being installed, a floor plate of relatively thin sheet metal 78 (FIG. 12A) is positioned beneath the film 76 at each splice location after crimping. This floor plate has upstanding flanges 80 and screw holes 82 by means of which it is later secured to the floor, the cable passing centrally over the plate 78 as indicated in FIG. 12A.

A receptacle base plate 84, FIG. 13, is then placed on the upper surface of the cable. This base plate is generally rectangular and has central openings 88 therein which surround the bent over holding lances 40, 42 so that these lances will not contact the metallic plate 84. Advantageously, a piece of insulating tape is applied to the exposed surfaces of these lances as a further precaution against their contacting the base plate. The base plate has feet 86 on its underside so that it will be supported avove the cable and it has slots 89 extending therethrough for reception of the tabs 70, two slots being provided along one edge and one slot adjacent to the other edge. The receptacle base plate 84 is then fastened down by screws which extend through holes 91 in the receptacle base plate and through the aligned holes 82 in the film 76 and floor plate 78.

After all of the connecting devices shown in FIG. 12 have been applied to the cable and the receptacle base plates have been fastened down to the floor, the carpet 90 is laid over the floor and covers all of the wiring and the base plates. The technician then determines the locations of the receptacle base plates 84 and cuts the carpet along the three sides 93 of each base plate. In each case, this cut produces a flap 92 (FIG. 14) which is lifted up to expose the base plate so that the receptacle 20 can be assembled to the cable.

Each receptacle assembly comprises a metallic housing having a top wall 94, a back wall 96, a straight front wall 98, and end walls 99. A conventional duplex electrical receptacle 100 is mounted in the housing adjacent to the front wall 98 and wires 102 are secured to the terminal screws of this receptacle which have push-on type terminals on their ends. In the embodiment shown, these push on terminals are contained in insulating housings 104 and are of a size adapted to be mated with the tabs 70 of the connecting devices 68. The housing also has an internal wall 106 which extends between the endwalls 99, an opening being provided in wall 106 for one of the wires 102. An opening 108 is provided in the top wall 94 for a screw 110 which is adapted to be threaded into the central threaded hole 112 in the receptacle base plate.

The technician proceeds to install the outlet by simply pushing the terminals 104 onto the appropriate tabs 70. He then folds the rug flap 92 and stuffs it into the cavity in the housing which lies between the back wall 96 and internal wall 106. Finally, he threads the screw 110 into the hole 112 and tightens the housing against the housing base plate. If it should ever become necessary to remove an outlet, it is merely required that the steps described above be repeated in reverse order until the housing base plate 84 has been removed. The tabs 70 can then be broken off and the exposed metal surfaces covered with tape. Finally, the flap 92 is positioned over the cable and bonded to its upper surface.

What is claimed is:

1. A crimped electrical connection between a connecting device and a ribbon-like conductor, said conductor being contained in a thin film of insulating material:

said connecting device comprising a sheet metal member having a flat web and having sidewalls extending from two opposite edges of said web, said conductor extending across said web, said conductor having its longitudinal axis extending parallel to, and between, said sidewalls, said sidewalls extending through said film on each side of said conductor and being bent inwardly towards each other and against said film, side sidewalls having free end portions which extend substantially parallel to said web and said film so that said crimped connection is substantially flat, at least one contact lance struck from said web, said lance being on the same side of said web as said sidewalls and extending transversely with respect to said longitudinal axis of said conductor and towards one of said sidewalls, said lance having a leading edge which extends parallel to said axis of said conductor and which is proximate to one of said sidewalls, said lance being flexed towards said web and being held in a flexed condition by one of said sidewalls, portions of said insulating film on the side of said film which is against said lance being scraped from said conductor, portions of said lance being against exposed areas of said conductor and in electrical contact therewith whereby, said conductor is clamped between said sidewall and said lance and electrical contact is maintained by the pressure exerted against said conductor.

2. A crimped electrical connection between a connecting device and a ribbon-like conductor, said conductor being contained in a thin film of insulating material, said connecting device comprising a sheet metal member having a flat web and having sidewalls extending from two opposite side edges of said web, said conductor extending across said web, said conductor having its longitudinal axis extending parallel to, and between, said sidewalls, said sidewalls extending through said insulating film on each side of said conductor and being bent inwardly towards each other and against said film, said sidewalls having free end portions which extend substantially parallel to said web and said film so that said crimped connection is substantially flat, first and second contact lance means struck from said web, said lance means extending in opposite directions from a central portion of said web with each lance means extending towards one of said sidewalls, said lance means having free ends and having leading edges on said free ends, said edges extending parallel to said axis of said conductor and parallel to said sidewalls, each of said lance means being flexed towards said web and being held in a flexed condition by said sidewalls, portions of said insulating film on the underside of said conductor which are against said lance means being scraped from said conductor and being accumulated adjacent to the leading edges of said lance means, portions of said lance means being against exposed areas of said conductor and in electrical contact therewith whereby, said conductor is held between said lance means and said sidewalls and said electrical contact is maintained by the pressure exerted against said conductor by said lance means.

3. A crimped connection as set forth in claim 2, each of said lance means comprising side-by-side lances struck from said web.

4. A crimped connection as set forth in claim 2, each of said lance means comprising two side-by-side lances.

5. A crimped connection as set forth in claim 2, and an elongated strip of sheet metal, said sidewalls and said lance means being formed from said strip, and further circuitry connected to said strip.

6. A crimped connection as set forth in claim 2, said web having openings therein proximate to said free ends of said, lance means said accumulated portions of said film being in said openings.

7. A crimped connection as set forth in claim 2, said web having stiffening ribs therein between said lance means.

8. A sheet metal connecting device for forming an electrical connection with a ribbon-like conductor in a flat conductor cable, said connecting device comprising:

a flat shank portion having a crimp portion at one end thereof, said crimp portion comprising a pair of parallel spaced-apart holding lances extending normally with respect to the plane of said shank portion, said holding lances being spaced-apart by a distance which is substantially equal to the width of conductor, said holding lances having free ends which are pointed, at least one contact lance between said holding lances, said contact lance extending on the same side of said device as said holding lances and extending obliquely towards one of said holding lances whereby, open impaling said cable on said holding lances and bending said holding lances towards the plane of said shank portion, said contact lance is moved relatively over said cable and portions of said insulating film are scraped from said conductor by said contact lance, and said contact lance contacts exposed portions of said conductor to establish electrical contact therewith.

9. A connecting device as set forth in claim 8, said device having at least two contact lances, said contact lances extending obliquely in opposite direction, each of said contact lances extending obliquely towards one of said holding lances.

10. A sheet metal connecting device for forming an electrical connection with a ribbon-like conductor in a flat conductor cable, said connecting device comprising:

a flat shank portion having a crimp portion at at least one end thereof, said crimp portion comprising a pair of parallel spaced apart holding lances, said holding lances extending normally of the plane of said shank portion and being spaced-apart by a distance which is substantially equal to the width of said conductor, portions of said crimp portion which are between said holding lances constituting a web a crimp portion, at least two contact lances struck from said web, said contact lances having inner ends which are spaced-apart on said web, said contact lances extending obliquely towards said holding lances whereby, upon impaling said cable on said holding lances so that said conductor extends across said web and between said holding lances, and upon bending said holding lances towards each other until they extend substantially parallel to said web, said contact lances will be flexed towards said web and free edges portions of said contact lances will scrape portions of said film from said conductor, and portions of said contact lances will be held in engagement with exposed portions of said conductor to establish electrical contact therewith.

11. A sheet metal connecting device as set forth in claim 10, said web having stiffening bosses therein between said contact lances.

12. A sheet metal connecting device as set forth in claim 10, said web having openings therein formed by said lances, said openings being oversized relative to said lances thereby to provide clearance for accumulated film material from cable when said connecting device is crimped into said cable.

13. A sheet metal connecting device as set forth in claim 10, said crimp portion constituting a first crimp portion, said shank having a second crimp portion, said second crimp portion being at the opposite end of said shank from said first crimp portion.

14. A sheet metal connecting device as set forth in claim 13, said second crimp portion having holding lances which extend parallel to, and are in alignment with, said holding lances of said first crimp portion.

15. A sheet metal connecting device as set forth in claim 13, said second crimp portion having holding lances which extend transversely with respect to said shank.

16. A sheet metal connecting device as set forth in claim 10, said connecting device having a connector tab, said tab extending from said shank at the opposite end of said shank from said crimp portion.

17. A sheet metal connecting device as set forth in claim 10, and at least one additional sheet metal connecting device, and a sheet of insulating film, said connecting device and said additional connecting device being mounted on said film in parallel spaced apart relationship whereby said connecting device and said additional connecting device can be crimped onto two ribbon-like conductors in a cable.

* * * * *

UNITED STATES PATENT OFFICE

CERTIFICATE OF CORRECTION

PATENT NO. : 3,960,430

DATED : Ju ne 1, 1976

INVENTOR(S) : Edward Dennman Bunnell, James Earl Fleischhacker and Robert John Tennant It is certified that error appears in the above-identified patent and that said Letters Patent are hereby corrected as shown below:

Column 6, line 13, after film, change "side" to - - - said - - -.

Column 7, line 34, after "of" insert - - - said - - -.

Column 8, line 7, after web change "a" to - - - of - - -.

Signed and Sealed this

Tenth Day of August 1976

[SEAL]

*Attest:*

RUTH C. MASON
*Attesting Officer*

C. MARSHALL DANN
*Commissioner of Patents and Trademarks*